United States Patent [19]

Shortt et al.

[11] Patent Number: 4,867,911

[45] Date of Patent: Sep. 19, 1989

[54] SURFACE TREATING WATER-IN-OIL EMULSION COMPOSITION AND METHOD

[75] Inventors: Alexandra B. Shortt, Houston; D. V. Satyanarayana Gupta, The Woodlands, both of Tex.

[73] Assignee: Pennzoil Products Company, Houston, Tex.

[21] Appl. No.: 144,463

[22] Filed: Jan. 19, 1988

Related U.S. Application Data

[63] Continuation of Ser. No. 76,993, Jul. 13, 1987, abandoned, which is a continuation of Ser. No. 806,773, Dec. 3, 1985, abandoned.

[51] Int. Cl.[4] ..... C11D 3/26

[52] U.S. Cl. ..... 252/544; 134/19; 134/20; 134/22.19; 134/36; 134/39; 134/40; 252/525; 252/357

[58] Field of Search ..... 134/20, 19, 22.19, 26, 134/39, 40; 252/544, 525, 357

[56] References Cited

U.S. PATENT DOCUMENTS

| | | | |
|---|---|---|---|
| Re. 21,530 | 8/1940 | Kritchevsky | 260/404 |
| 2,089,212 | 8/1937 | Kritchevsky | 260/404 |
| 2,238,478 | 4/1941 | Ott | 252/357 |
| 2,259,466 | 10/1941 | Harris et al. | 252/357 |
| 2,919,197 | 12/1959 | Duin et al. | 252/308 |
| 3,250,794 | 5/1966 | Mod et al. | 260/404 |
| 3,285,809 | 11/1966 | Mod et al. | 514/625 |
| 3,361,771 | 1/1968 | Magne et al. | 549/553 |
| 3,387,008 | 6/1968 | Cawley | 252/357 |
| 3,515,754 | 6/1970 | Mod et al. | 564/123 |
| 3,575,883 | 4/1971 | Foley | 252/354 |
| 3,622,518 | 11/1971 | Atherton | 252/357 |
| 3,634,284 | 1/1972 | Benson et al. | 252/357 |
| 3,766,085 | 10/1973 | Fahnenstich et al. | 252/357 |
| 3,844,731 | 10/1974 | Biasotti et al. | 44/66 |
| 4,010,105 | 3/1977 | Holgado | 252/77 |
| 4,024,097 | 5/1977 | Slovinsky et al. | 524/723 |
| 4,330,339 | 5/1982 | Nimerick | 252/357 |
| 4,330,422 | 5/1982 | Tesch | 252/89.1 |
| 4,439,342 | 3/1984 | Albanese | 252/305 |
| 4,439,343 | 3/1984 | Albanese | 252/305 |
| 4,439,344 | 3/1984 | Albanese | 252/312 |
| 4,483,783 | 11/1984 | Albanese | 252/312 |

*Primary Examiner*—Asok Pal

*Attorney, Agent, or Firm*—Lowe, Price, LeBlanc, Becker & Shur

[57] ABSTRACT

A surface-treating low-stability water-in-oil emulsion composition particularly adapted for cleaning a surface comprising at least one liquid hydrocarbon oil solvent, water, and an emulsifying agent comprising an N-alkanoyl-2,2'-iminobis(ethyl alkanoate). The emulsion composition may further include a compressed gas whereby the composition may be applied to a surface in the form of an aerosol.

15 Claims, No Drawings

SURFACE TREATING WATER-IN-OIL EMULSION COMPOSITION AND METHOD

This application is a continuation of application Ser. No. 076,993, filed July 13, 1987 which is a continuation of application Ser. No. 806,773, filed Dec. 9, 1985, both abandoned.

FIELD OF THE INVENTION

The present invention relates to surface treating low-stability water-in-oil emulsion compositions. The emulsion compositions are particularly adapted for cleaning a preheated surface and in another aspect the invention relates to a method for cleaning and treating surfaces with these novel compositions.

BACKGROUND OF THE INVENTION

It is generally known to employ oil-containing compositions for treating and cleaning various surfaces. Such compositions have been in various forms, including pastes, solutions, lotions, creams and emulsions. Numerous surfactants or emulsifying agents are known for preparing oil-in-water emulsions and water-in-oil emulsions. Condensation products of diethanolamine with long chain monocarboxylic acids as disclosed, for instance, in Kritchevsky U.S. Pat. Nos. Re 21,530 and 2,089,212, are used commercially as detergent surfactants and as other surfactants in a number of industries. U.S. Pat. No. 4,330,422 to Tesch relates to a surface treating composition especially suited for cleaning and treating stainless steel comprising an aqueous emulsion of white mineral oil wherein a preferred emulsifier comprises fatty acid alkanolamides. U.S. Pat. Nos. 4,439,342–344 and 4,483,783 to Albanese relate to surface covering emulsions including a dispersal agent consisting of cocodiethanolamide. Similarly, U.S. Pat. No. 3,387,008 to Cawley relates to alkanolamides of fatty acids having particular utility as surfactants. It is generally known in the art, however, as taught by Cawley, that monoester amides and diester amides are poor surfactants.

Many condensation products of diethanolamine with long chain monocarboxylic acids have disadvantages which impair their use as surfactants in water-in-oil and oil-in-water emulsions. For example, some fatty acid diethanolamide compounds are known to rearrange to the corresponding fatty acid diethanolamine ester at slightly elevated temperatures and thus detrimentally affect the ability of the amide-containing composition to perform as an emulsifier. Other condensation products of diethanolamine with long chain monocarboxylic acids are difficult to prepare in a form which is uncontaminated by other side products which detrimentally affect the emulsifying properties. Finally, amide ester and amide diester condensation products have been generally known to be poor surfactants due to their increased hydrophobicity and decreased water solubility. These characteristics make it unexpected that amide ester and amide diester condensation products would be useful in surfacetreating compositions, especially in view of their hydrophobicity.

SUMMARY OF THE INVENTION

It is therefore an object of the present invention to provide new and improved surface treating low-stability water-in-oil emulsion compositions which avoid the previously disclosed disadvantages of the prior art. A low-stability water-in-oil emulsion is defined as a water-in-oil mixture which forms a stable emulsion when initially prepared and stored. However, when the mixture is applied to a surface, such as by spraying, the oil component forms a continuous coating on the surface, which coating sheds the water phase, thereby breaking the emulsion.

It is also an object of the present invention to provide a surface treating water-in-oil emulsion composition including an emulsifying agent which is stable and does not rearrange to form a compound which adversely affects the emulsion composition at elevated temperatures and over extended periods of time. Moreover, the emulsifying agent may be easily prepared in a form which is not contaminated by undesirable side products.

Moreover, it is an object of the invention to provide a surface treating water-in-oil emulsion composition which may be used to clean oil, grease and other debris from a heated or preheated surface.

It is a further object of the present invention to provide a method for treating a surface, and more particularly a method for cleaning a surface with the novel and improved water-in-oil emulsion composition of the present invention.

The above and other advantages and improvements are provided by a surface treating low-stability waterin-oil emulsion composition which comprises at least on liquid hydrocarbon oil solvent, water and an emulsifying agent. The emulsifying agent comprises a diethanolamide diester, specifically, an N-alkanoyl-2,2'-iminobis-(ethyl alkanoate). In a preferred embodiment, the surface treating water-in-oil emulsion composition further includes a compressed gas whereby the composition may be applied to a surface in the form of an aerosol.

The method of the present invention relates to the surface treating or cleaning of a surface by applying to the surface low-stability water-in-oil emulsion compositions as disclosed herein. In a preferred embodiment, the surface will have been preheated prior to applying the emulsion composition. When the emulsion composition is used to treat a hot surface, for example a hot automobile engine surface, the lowstability emulsion composition is sprayed on the hot surface. The hydrocarbon oil solvent forms a continuous phase which coats the surface and acts to dissolve the grease, oil, dirt and other grime from the surface. The continuous oil coating sheds the water from the unstable emulsion and the water is converted into steam by the hot surface and aids the removal of dirt and other debris from the surface. The water provides an inexpensive, non-flammable carrier while the continuous solvent coating acts as the grease and dirt dissolving active medium.

These and other advantages and objects of the present invention will become apparent from the detailed disclosure of the invention.

DETAILED DESCRIPTION

The present invention relates to a surface treating low-stability water-in-oil emulsion composition and to a method for treating a surface with the water-in-oil emulsion composition. The water-in-oil emulsion composition is particularly adapted for cleaning a surface by dissolving grease, oil, dirt and other materials therefrom.

As set forth previously, a low-stability water-in-oil emulsion is defined as a water-in-oil mixture which forms a stable emulsion when initially prepared and stored. However, when the mixture is applied to a surface, such as by spraying, the oil component forms a continuous coating on the surface, which coating sheds the water phase, thereby breaking the emulsion.

The water-in-oil emulsion composition comprises at least one liquid hydrocarbon oil solvent, water and an emulsifying agent comprising a diethanolamide diester. Specifically, the emulsifying agent comprises Nalkanoyl-2,2'-iminobis(ethyl alkanoate) having the following formula:

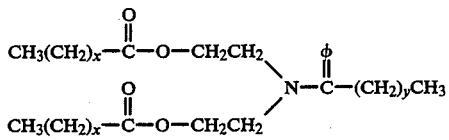

wherein x and y are integers ranging from about 6 to about 16. In a more preferred embodiment x and y are integers ranging from 8 to 14 and may be the same or different.

In a preferred embodiment, the water-in-oil emulsion composition further includes a compressed gas, whereby the composition may be applied to a surface in the form of an aerosol.

In accordance with the method of the invention, the emulsion composition is applied to a surface, preferably a preheated surface such as, for example, a dirty automobile engine exterior. Since the composition comprises a low-stability water-in-oil emulsion system, the hydrocarbon oil solvent forms a continuous phase which coats the surface. The oil solvent dissolves grease, oil and other dirt adhering to the surface. The continuous oil solvent coating sheds the water phase from the unstable emulsion and the water may be converted into steam by the heat from the hot surface. The steam aids the removal of the dirt and other debris from the surface.

The liquid hydrocarbon oil solvent which is employed in the emulsion composition of the invention may be selected from any of the well known petroleum-based hydrocarbon oils or synthetic hydrocarbon oils. The composition includes at least one liquid hydrocarbon oil and in preferred embodiments includes a mixture of two or more liquid hydrocarbon oils. Particularly preferred liquid hydrocarbon oils include kerosene, xylene and mixtures thereof. The liquid hydrocarbon oil is included in the emulsion composition in an amount ranging from approximately 20 to 35 wt. % in order to provide the desired low stability water-in-oil emulsion properties.

Similarly, the emulsion composition includes water in an amount ranging from approximately 65 to 80% by weight in order that the composition has the desired low-stability water-in-oil emulsion properties. The emulsifying agent is included in the composition in an amount necessary to form the low stability water-in-oil emulsion whereby, once the composition is applied to a surface, the oil solvent will act to coat the surface and shed the water therefrom. In accordance with a preferred embodiment of the invention, the emulsifying agent is included in an amount ranging from approximately 0.0125 to 5.0 weight percent. The emulsifying agent may be added to the composition in either a liquid hydrocarbon oil solvent carrier or a water carrier.

As set forth above, the emulsion composition may further include a compressed gas whereby the composition may be applied to a surface in the form of an aerosol. The compressed gas may comprise nitrogen, carbon dioxide, nitrous oxide, or hydrocarbon normally gaseous propellants including propane, isopropane, butane, isobutane, and mixtures thereof. Halogenated hydrocarbon propellant such as chlorodifluoromethane, dichlorotetrafluoroethane, dichlorodifluoromethane, and the like can also be used. If the compressed gas is included in the composition, it is employed in an amount ranging from approximately 0.1 to several weight percent.

The water-in-oil emulsion composition may further include other additives well known in the art which do not affect the low stability water-in-oil emulsion properties of the composition. For example, a preservative such as sodium benzoate may be included in amounts which would be obvious to one skilled in the art ranging approximately from 0.05 to several weight percent.

In one embodiment the diethanolamide diester emulsifying agent for use in the present invention may be produced according to the following condensation reaction between the acid and diethanolamine:

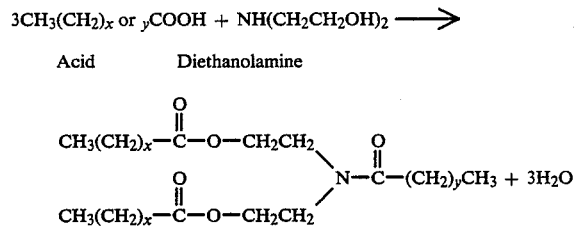

The above reaction is a preferred procedure where x and y are the same. However, the acid reactant may be replaced by the corresponding acid chloride in which case the by-product is HCl. Also, when x and y are to be different integers, the diethanolamine is initially reacted with one mole of the acid or acid chloride to form the amide and provide the y moiety. This intermediate is then reacted with two moles of acid or acid chloride to produce the final product and provide the x moieties.

Since the formation of the diester is an equilibrium process, the reaction must be pushed to completion by removing the water coproduct as it is formed or by using an excess amount of the acid. The reaction is carried out at a preferred temperature of about 125° to 200° C.

The diethanolamide diester may be specifically formed in accordance with the following examples where parts are by weight unless otherwise indicated.

EXAMPLE 1

Lauric Diethanolamide Diester

Condensation reactions were carried out by (a) mixing lauric acid and diethanolamine at room temperature and (b) mixing molten lauric acid and preheated diethanolamine. The mixtures were then heated until the theoretical amount of water was collected. Nitrogen gas was bubbled through the molten reaction mixture to aid removal of water. Water condensation occurred in three stages, at 140° C., 170° C. and 200° C. The reaction mixtures were maintained below 230° C. in order to prevent charring. The reactions were completed in approximately 2 hours. The amount of excess lauric acid used in the condensation reactions was varied until it was determined that a ratio of 3.5 moles of lauric acid to 1 mole of diethanolamine provided a satisfactory product containing very little or no undesirable side products. As determined by high pressure liquid chromatography the emulsifying agent produced by this method contained approximately 84 to 94 percent N-lauroyl-2,2'-iminobis(ethyl laurate), less than 1% of the amide ester, and no lauric diethanolamide, with the remainder being lauric acid.

EXAMPLE 2

Lauric Diethanolamide Diester

A second method for the production of the lauric diethanolamide diester may be used wherein the condensed water is removed as it is condensed by forming an azeotrope with a xylene solvent. A satisfactory product having little or no undesirable side products was produced when 3.1 moles of lauric acid were reacted with 1 mole of diethanolamine in a 50% by weight solution in a xylene solvent. The reaction proceeded for 7.5 hours at temperatures ranging from 145 to 156° C. High pressure liquid chromatography analysis of samples taken at half hour intervals revealed that the reaction was complete after 5 hours with no amide left unreacted.

Either of the condensation reactions set forth in Examples 1 and 2 may be used to produce a diethanolamide diester emulsifying agent of the present invention. The method according to Example 1 using the acid reactant is preferred in that a satisfactory and pure product is provided in a shorter time and in a more economical manner.

EXAMPLES 3, 4 AND 5

By reaction of diethanolamine with the appropriate acid chloride, the following additional emulsifying agents within the scope of the invention were prepared:
Example 3—N-decanoyl-2,2'-iminobis(ethyl decanoate)
Example 4—N-myristoyl-2,2'-iminobis(ethyl myristate)
Example 5—N-lauroyl-2,2'-iminobis(ethyl myristate).

These reactions provided a mixture of products which necessitated purification of the desired amide diesters by centrifugally accelerated preparative thin layer chromatography on silica gel using ethyl acetate/-hexanes to elute. The structures of all three compounds were confirmed by IR, NMR and MS. The physical data are set forth below:

| Example | IR Carbonyl Bands |
|---|---|
| 3 | 1651 $cm^{-1}$; 1736 $cm^{-1}$ |
| 4 | 1653 $cm^{-1}$; 1734 $cm^{-1}$ |
| 5 | 1653 $cm^{-1}$; 1734 $cm^{-1}$ |

According to the method of the present invention, the low-stability water-in-oil emulsion composition is applied to a surface. Preferably, the surface is heated prior to the application of the emulsion composition and the emulsion composition serves to clean grease, oil, dirt and other debris from the surface. The composition of the present invention forms a temporary "creamy" emulsion between the organic and aqueous phases. Upon spray application of the emulsion composition on a surface, the emulsion "breaks" whereby the solvent coats the surface and provides a continuous organic material covering. In accordance with the low-stability characteristics, the oil solvent- coated surface sheds the water contained in the composition. The solvent coating serves to dissolve grease, oil and other debris on the surface. Heat from the preheated surface serves to convert the water from the emulsion into steam, the steam aiding in the removal of the dirt and other debris from the surface. Thus, the water serves as a non-flammable carrier and aids in the cleaning of the surface.

EXAMPLE 6

In the following Table I, the emulsions of the invention were evaluated as emulsifiers. The emulsifying agents tested were as follows:

A. N-lauroyl-2,2'-iminobis(ethyl laurate)—Ex. 1
B. N-decanoyl-2,2'-iminobis(ethyl decanoate)—Ex. 3
C. N-myristoyl-2,2'-iminobis(ethyl myristate)—Ex. 4
D. N-lauroyl-2,2'-iminobis(ethyl myristate)—Ex. 5
E. Mixture of A and B (50:50)
F. Mixture of A and C (50:50)

The samples were prepared in the concentrations listed. Emulsifier concentrates of Sample A were prepared by dissolving one gram of each agent in three grams of xylene. The emulsions were then prepared using the described concentrations. Samples B, C, D, E and F were prepared as 5 percent by weight solutions in xylenes of the compound to be tested. Formulations containing (by weight) 14 percent xylenes, 1 percent emulsifier solution, 15 percent kerosene, 2.5 percent of 8 percent sodium benzoate, and 67.5 percent deionized water were prepared with these five samples to give an active emulsifier concentration of 0.05 weight percent. The emulsion characteristics and the necessary instability of the degreaser formulation were evaluated. The formulations were then sprayed onto an aluminum plate to determine the shedding characteristics. Even though the formulations were not optimized for emulsifier content, they all performed satisfactorily in the described tests. These results indicate that individual compounds are useful as emulsifiers in this formulation and that physical mixtures of amide diesters with different carbon chain lengths are also useful.

TABLE I

| Sample | Percentage of Emulsifier | Emulsion Characteristics | Shedding |
|---|---|---|---|
| A | 2.5% | Excellent | Satisfactory |
| A | 0.025% | Excellent | Satisfactory |
| B | 0.05% | Satisfactory | Satisfactory |
| C | 0.05% | Satisfactory | Satisfactory |
| D | 0.05% | Satisfactory | Satisfactory |
| E | 0.05% | Satisfactory | Satisfactory |
| F | 0.05% | Satisfactory | Satisfactory |

EXAMPLE 7

Several emulsion compositions were prepared according to the present invention including lauric diethanolamide diester, the concentration range of the diethanolamide diester being between 0.0125 and 0.5 weight percent. The product stability of the formulations was confirmed by passing the formulations through three freeze thaw cycles according to ASTM D-3209. The formulations were also heat-treated at 125° F. for 30 days. ASTM 1791 states that this is equivalent to one year stability at 21° C. Subsequent testing did not detect the presence of any amide or amine after the long term heat treatment. Thus, the emulsion composition including the amide diester proved to be stable to decomposition to the amide or amine.

EXAMPLE 8

Low stability water-in-oil emulsion compositions were prepared in accordance with the present invention. The composition of Formulations A and B were as follows:

TABLE II

| | Formulation A | Formulation B |
|---|---|---|
| Kerosene | 15.0 | 15.0 |
| Xylene | 15.875 | 15.975 |
| Lauric diethanolamide diester emulsifier | 0.125 | 0.025 |
| Water | 68.3 | 68.3 |
| Sodium benzoate | 0.2 | 0.2 |
| Nitrogen | 0.5 | 0.5 |

Each emulsion composition was spray applied to a preheated dirty automobile engine exterior in the form of a temporary creamy emulsion. The emulsion breakdown between the organic and aqueous phases caused the organic solvent to form a continuous coating and the shedded water to evaporate as steam. Ten to fifteen minutes after application of the emulsion composition, the product was rinsed off with pressurized water, thus removing the grease, oil, dirt and other debris from the engine. Both formulations exhibited satisfactory performance.

While specific embodiments of this invention have been described in detail, variations and modifications of the specific embodiments can be effected without departing from the spirit and scope of the invention as disclosed and claimed.

What is claimed is:

1. A water-in-oil emulsion composition comprising:
at least one liquid hydrocarbon oil solvent,
water, and
as a sole emulsifying agent an N-alkanoyl-2,2'-iminobis(ethyl alkanoate) having the formula:

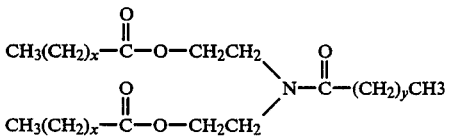

wherein
x and y are integers of 6–16.

2. The water-in-oil emulsion composition of claim 1, wherein
x and y are the same or different and are 8–14.

3. The water-in-oil emulsion composition of claim 1, further comprising
a preservative comprising sodium benzoate.

4. The water-in-oil emulsion of claim 1, wherein
the at least one liquid hydrocarbon oil solvent comprises a mixture of two liquid hydrocarbon oil solvents.

5. The oil-in-water emulsion composition of claim 4, wherein
said liquid hydrocarbon oil solvents comprise kerosene and xylene.

6. The water-in-oil emulsion composition of claim 1, wherein
the at least one liquid hydrocarbon oil solvent comprises two liquid hydrocarbon oil solvents; and the composition further comprises
a compressed gas and a preservative.

7. The water-in-oil emulsion composition of claim 6, wherein
said two liquid hydrocarbon oil solvents comprise kerosene and xylene,
said compressed gas comprises nitrogen, and
said preservative comprises sodium benzoate.

8. The oil-in-water emulsion composition of claim 7, wherein
said emulsifying agent is present in an amount of about 0.0125 to 5.0 wt % of the composition.

9. The water-in-oil emulsion composition of claim 7, wherein
said kerosene is present in an amount of about 15 wt %,
said xylene is present in an amount of about 15.5 to 16 wt %,
said water is present in an amount of about 68 wt %,
said nitrogen is present in an amount of about 0.5 wt %, and
said sodium benzoate is present in amount of about 0.2 wt %.

10. The oil-in-water emulsion composition of claim 1, wherein
said sole emulsifying agent is present in an amount of about 0.0125 to 5.0 wt %.

11. The water-in-oil emulsion composition of claim 10, wherein
said emulsifying agent is N-lauroyl-2,2'-iminobis-(ethyl laurate).

12. An aerosol preparation for cleaning a surface comprising
at least one liquid hydrocarbon oil solvent,
water,
a compressed gas, and
as a sole emulsifying agent an N-alkanoyl-2,2'iminobis (ethyl alkanoate) of the formula:

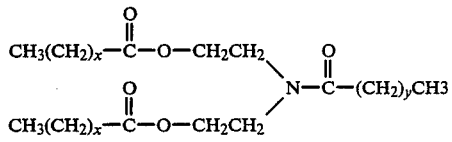

wherein
x and y are integers of 6–16.

13. The aerosol preparation of claim 12, wherein
the at least one liquid hydrocarbon oil solvent is a mixture of two liquid hydrocarbon oil solvents.

14. The aerosol preparation of claim 13, wherein
said two liquid hydrocarbon oil solvents comprise kerosene and xylene, and
said compressed gas comprises nitrogen.

15. The aerosol preparation of claim 14, wherein
said kerosene is present in an amount of about 15 wt %,
said xylene is present in an amount of 15.5–16 wt %,
said water is present in an amount of about 68 wt %,
said nitrogen is present in an amount of about 0.5 wt %, and
said sole emulsifying agent is present in an amount of about 0.0125 to 0.5 wt %, and said aerosol preparation further comprises
a preservative comprising sodium benzoate in an amount of about 0.2 wt % of said aerosol preparation.

* * * * *